US005666133A

United States Patent [19]

Matsuo et al.

[11] Patent Number: 5,666,133

[45] Date of Patent: Sep. 9, 1997

[54] METHOD FOR DRIVING LIQUID CRYSTAL DISPLAY UNIT

[75] Inventors: Shigeki Matsuo; Seiichi Nagata, both of Yohkaichi, Japan

[73] Assignee: Kyocera Corporation, Kyoto, Japan

[21] Appl. No.: 630,565

[22] Filed: Apr. 10, 1996

Related U.S. Application Data

[63] Continuation of Ser. No. 253,584, Jun. 3, 1994, abandoned, which is a continuation of Ser. No. 976,559, Nov. 16, 1992, abandoned.

[30] Foreign Application Priority Data

Dec. 13, 1991 [JP] Japan ..... 3-330592

[51] Int. Cl.[6] ..... G09G 3/36

[52] U.S. Cl. ..... 345/100; 345/96; 345/90

[58] Field of Search ..... 345/94, 95, 96, 345/98, 100, 92, 93, 99, 208, 209, 210, 213

[56] References Cited

U.S. PATENT DOCUMENTS

| | | | |
|---|---|---|---|
| 4,393,380 | 7/1983 | Hosokawa | 340/784 CL |
| 4,404,555 | 9/1983 | Long | 340/784 DL |
| 4,571,584 | 2/1986 | Suzuki | 345/94 |
| 4,870,398 | 9/1989 | Bos | 345/210 |
| 4,928,095 | 5/1990 | Kawahara | 345/93 |

OTHER PUBLICATIONS

Floyd, "Electronic Devices", 1984, p. 26.

*Primary Examiner*—Xiao Wu
*Attorney, Agent, or Firm*—Loeb & Loeb LLP

[57] ABSTRACT

Disclosed is a method for driving a liquid crystal display unit, in particular, a method for driving an active matrix type liquid crystal display unit using a thin-film transistor as a switching element. According to the drive method, a plurality of scanning signal power voltages of which levels vary in synchronization with inversion in polarity of an image signal are input to a scanning signal supply circuit, and any of the plural scanning signal power voltages is selected to serve as a scanning signal. Otherwise, some scanning signal power voltages of which levels vary in synchronization with inversion in polarity of the image signal and some scanning signal power voltages of which levels are invariable are input to the scanning signal supply circuit, and any of the plural scanning signal power voltages is selected to serve as a scanning signal.

6 Claims, 6 Drawing Sheets

METHOD FOR DRIVING LIQUID CRYSTAL DISPLAY UNIT

This is a continuation of application Ser. No. 08/253,584 filed on Jun. 3, 1994, and now abandoned, which is itself a continuation of 07/976,559 filed Nov. 16, 1992, also abandoned.

BACKGROUND OF THE INVENTION

1. Field of the Invention

The present invention relates to a method for driving a liquid crystal display unit, and more particularly to a method for driving an active matrix type liquid crystal display unit using a thin film transistor as a switching element.

2. Description of the Prior Art

In recent years, active matrix type liquid crystal display units are increasingly used in such devices as compact TV sets, projection TV sets, and view finders. However, such a display unit is inferior to a CRT display unit in terms of flicker, screen burning after displaying a still image, uniformity of an image displayed on the screen, gradation display capability, cost, and other factors.

The following describes a conventional method for driving an active matrix type liquid crystal display unit with reference to FIGS. 6 and 7.

FIG. 6 shows the construction of an exemplified conventional active matrix type liquid crystal display unit, while FIG. 7 shows an equivalent circuit of one pixel in the construction shown in FIG. 6. Referring to FIGS. 6 and 7, there are comprised an image signal supply circuit 21, a scanning signal supply circuit 22, an image signal line 15, a scanning signal line 16, a counter electrode line 17, a switching transistor 18, a pixel electrode 19, a capacitance 20 ($C_{LC}$) of the liquid crystal material across the counter electrode 17 and the pixel electrode 19, and a parasitic capacitance 14 ($C_{GD}$) across the gate and the drain of the switching transistor 18.

In the active matrix type liquid crystal display unit, a plurality of image signal lines 15 and a plurality of scanning signal lines 16 are provided intersecting each other, and at each intersecting point are provided in a matrix form the pixel electrode 19 and the switching transistor 18 which applies a voltage to the pixel electrode 19. Then a scanning signal $V_G$ is supplied from the scanning signal supply circuit 22 to the gate of the switching transistor 18 via the scanning signal line 16 to control turning on and off the switching transistor 18. Meanwhile, an image signal $V_S$ is supplied from the image signal supply circuit 21 to the pixel electrode 19 via the image signal line 15 as well as the source and the drain of the switching transistor 18. The image signal $V_s$ and a counter electrode signal to be supplied to the counter electrode 17 are applied across a liquid crystal material interposed between the counter electrode 17 and the pixel. electrode 19 to display an image.

FIG. 8 shows waveforms of the scanning signal $V_G$, the image signal $V_s$, and an effective voltage $V_B$ to the liquid crystal material. The scanning signal $V_G$ is a signal to be supplied from the scanning signal supply circuit 22 to the gate of the switching transistor 18 as composed of a voltage $V_{GH}$ for turning on the switching transistor 18 and a voltage $V_{GL}$ for turning off the switching transistor 18. The image signal $V_s$ is a signal to be supplied from the image signal supply circuit 21 to the pixel electrode 19 as inverted in polarity every one horizontal scanning period (1H) between a positive voltage $V_s^+$ and a negative voltage $V_s^-$. The effective voltage $V_B$ applied to the liquid crystal material is a voltage actually applied across the liquid crystal material interposed between the pixel electrode 19 and the counter electrode 17.

The following describes the operation of the liquid crystal display unit having the above-mentioned construction with reference to FIGS. 7 and 8. Assuming now that the scanning signal $V_{GH}$ is applied to the gate of the switching transistor 18 with the positive image signal voltage $V_s^+$ applied to the image signal line 15, the switching transistor 18 turns on to apply the image signal voltage $V_s^+$ to the liquid crystal material. When the scanning signal $V_{GL}$ is applied to the gate of the switching transistor 18, the switching transistor 18 turns off. Consequently, the application voltage $V_B$ to the liquid crystal material reduces by $\Delta V$ due to the capacitance $C_{GD}$ between the gate and the drain of the switching transistor 18. The application voltage $V_B$ to the liquid crystal material is maintained by the capacitance $C_{LC}$ of the liquid crystal material itself until the next cycle of the scanning signal $V_G$. In the next cycle, the scanning signal $V_{GH}$ is applied to the gate of the switching transistor 18 with the image signal $V_s^-$ being the inverted form of the image signal $V_s$ applied to the image signal line 15 to consequently apply the image signal voltage $V_s^-$ to the liquid crystal material. When the scanning signal $V_{GL}$ is applied to the gate of the switching transistor 18, the application voltage $V_B$ to the liquid crystal material reduces by A $\Delta$ to maintain the resulting voltage. Therefore, as shown in FIG. 8, the application voltage $V_B$ to the liquid crystal material is periodically inverted in polarity. When the scanning signal $V_G$ changes from $V_{GH}$ to $V_{GL}$, the electric potential at the pixel electrode 19 is varied by the parasitic capacitance $C_{GD}$ between the gate and the drain of the switching transistor 18 to vary the voltage $V_B$ applied to the liquid crystal material. The variance $\Delta V$ of the voltage $V_B$ applied to the liquid crystal material is expressed by the following equation:

$$\Delta V = C_{GD} \cdot (V_{GH} - V_{GL}) / (C_{LC} + C_{GD})$$

In order to compensate for the variance $\Delta V$ of the voltage $V_B$ applied to the liquid crystal material, the voltage to be applied to the counter electrode 7 is preset at the central value $V_{BC}$ of the voltage $V_B$ applied to the liquid crystal material to symmetrically arrange the positive polarity voltage and the negative polarity voltage applied to the liquid crystal material. In other words, the above-mentioned voltage is adjusted so that the equation of $V_{BC} = V_{SC} - \Delta V$ holds. It is noted that the value $V_{SC}$ of the voltage $V_B$ applied to the liquid crystal material is the central value of the image signal $V_S$. Even though the voltage to be applied to the counter electrode 17 is preset at the value $V_{BC}$, i.e., the central value of the voltage $V_B$ applied to the liquid crystal material as described above, there is no compensation for an effective direct current component which is generated by the variance $\Delta V$ due to the dielectric anisotropy (the property that the dielectric constant of the liquid crystal material varies according to a voltage applied to the material) of the liquid crystal material and applied to the liquid crystal material, which has lead to the problems of flicker and screen burning occurring after displaying a still image.

In order to give solution to the above-mentioned problems, for example, Japanese Patent Application Laid-Open Publication No. Hei-2-157815 proposes to further provide a line (not shown) connected to the pixel electrode 19 via an additional capacitance (not shown) and apply a modulation signal of which polarity is inverted every one field to the line to modulate the electric potential at the pixel electrode 19 for the purpose of improving the display image quality and drive reliability as well as reducing drive power.

However, the above-mentioned construction fatally necessitates a modulation signal supply circuit having output terminals corresponding in amount to the scanning signal lines 16 and modulation signal lines other than the image signal supply circuit 21 and the scanning signal supply circuit 22 to result in increasing the circuit scale. It has been also proposed to superimpose the modulation signal on the scanning signal in the previous stage, however, such a construction requires a significantly complicated scanning signal to result in increasing the circuit scale of the scanning signal supply circuit. Furthermore, the voltage applied to the liquid crystal material fluctuates in amplitude due to the dielectric anisotropy of the liquid crystal material to result in several problems such as difficult gradation controllability of the liquid crystal display panel.

SUMMARY OF THE INVENTION

The present invention is made in view of the above-mentioned conventional technical problems, and accordingly, it is an object of the present invention to provide a method for driving a liquid crystal display unit capable of eliminating the variance of the application voltage attributable to the dielectric anisotropy of the liquid crystal material with a relatively simple circuit construction to assure an excellent gradation controllability without incurring flicker nor burning of the screen.

In order to achieve the above-mentioned objective, herein provided is a first inventive method for driving a liquid crystal display unit characterized by interposing a liquid crystal material between a plurality of pixel electrodes and an electrode connecting a switching transistor to each of the plural pixel electrodes; supplying a scanning signal for turning on and off the switching transistor from a scanning signal supply circuit to the switching transistor via a scanning signal line; supplying an image signal from an image signal supply circuit to each of the pixel electrodes via an image signal line and the switching transistor; eliminating a direct current component of a voltage applied to the liquid crystal material by supplying a scanning signal of an adjacent scanning signal line to the pixel electrode via an additional capacitance; and supplying a counter electrode signal to a counter electrode, whereby a plurality of scanning signal power voltages of which levels vary in synchronization with inversion in polarity of the image signal are input to the scanning signal supply circuit, and any of the plural scanning signal power voltages is selected to serve as the scanning signal.

Further provided herein is a second inventive method for driving a liquid crystal display unit characterized by interposing a liquid crystal material between a plurality of pixel electrodes and an electrode; connecting a switching transistor to each of the plural pixel electrodes; supplying a scanning signal for turning on and off the switching transistor from a scanning signal supply circuit to the switching transistor via a scanning signal line; supplying an image signal from the image signal supply circuit to each of the pixel electrode via an image signal line and the switching transistor; eliminating a direct current component of a voltage applied to the liquid crystal by supplying a scanning signal of an adjacent scanning signal line to the pixel electrode via an additional capacitance; and supplying a counter electrode signal to a counter electrode, whereby some scanning signal power voltage of which levels vary in synchronization with inversion in polarity of the image signal and some scanning signal power voltages of which levels are invariable are input to the scanning signal supply circuit, and any of the plural scanning signal power voltages is selected to serve as the scanning signal.

With the above-mentioned arrangement, the modulation signal can he supplied from the scanning signal line as superimposed on the scanning signal, and therefore no special modulation signal supply circuit nor modulation signal lines are necessary with reducing the circuit scale of the scanning signal supply circuit. As a consequence, the direct current component of the voltage applied to the liquid crystal material is eliminated to enable the image signal supply circuit and the scanning signal supply circuit to be compacted, achieving a method for driving a liquid crystal display unit which requires low power consumption assuring an excellent gradation reproducibility without incurring burning of the screen.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The following describes in detail the present invention with reference to the attached drawings.

Figure 1:
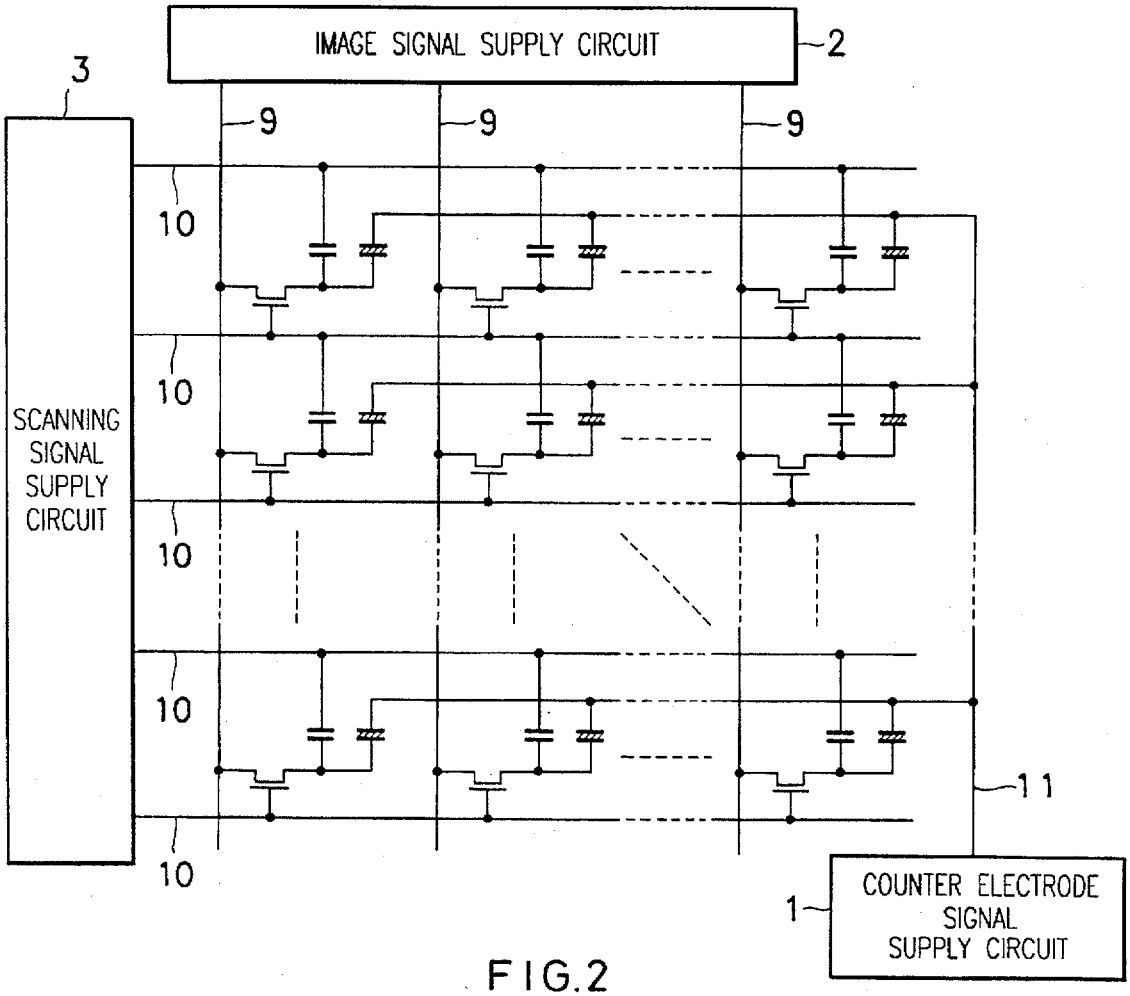
FIG. 1 is a diagram of a liquid crystal display unit in accordance with an embodiment of the present invention.
Figure 2:
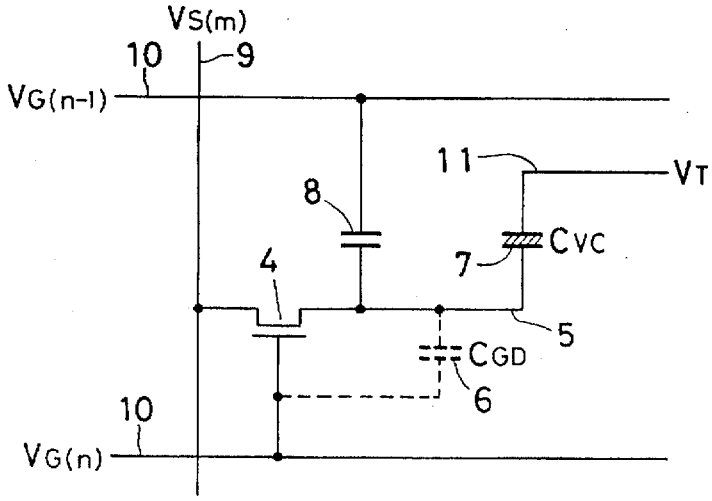
FIG. 2 is an equivalent circuit diagram of one pixel of the liquid crystal display unit of the present invention.

FIG. 1 is a diagram of an active matrix type liquid crystal display unit, while FIG. 2 is an equivalent circuit diagram of one pixel of the liquid crystal display unit shown in FIG. 1. Referring to FIGS. 1 and 2, there are comprised a counter electrode signal supply circuit 1, an image signal supply circuit 2, a scanning signal supply circuit 3, a switching transistor 4, a pixel electrode 5, a parasitic capacitance 6 ($C_{GD}$) across the gate and the drain of the switching transistor 4, a capacitance 7 ($C_{LC}$) of the liquid crystal material across the pixel electrode 5 and a counter electrode 11, an additional capacitance 8 ($C_S$) across the pixel electrode 5 and a scanning signal line 10 in the previous stage, an image signal line 9, the scanning signal line 10, and the counter electrode line 11.

Figure 3:
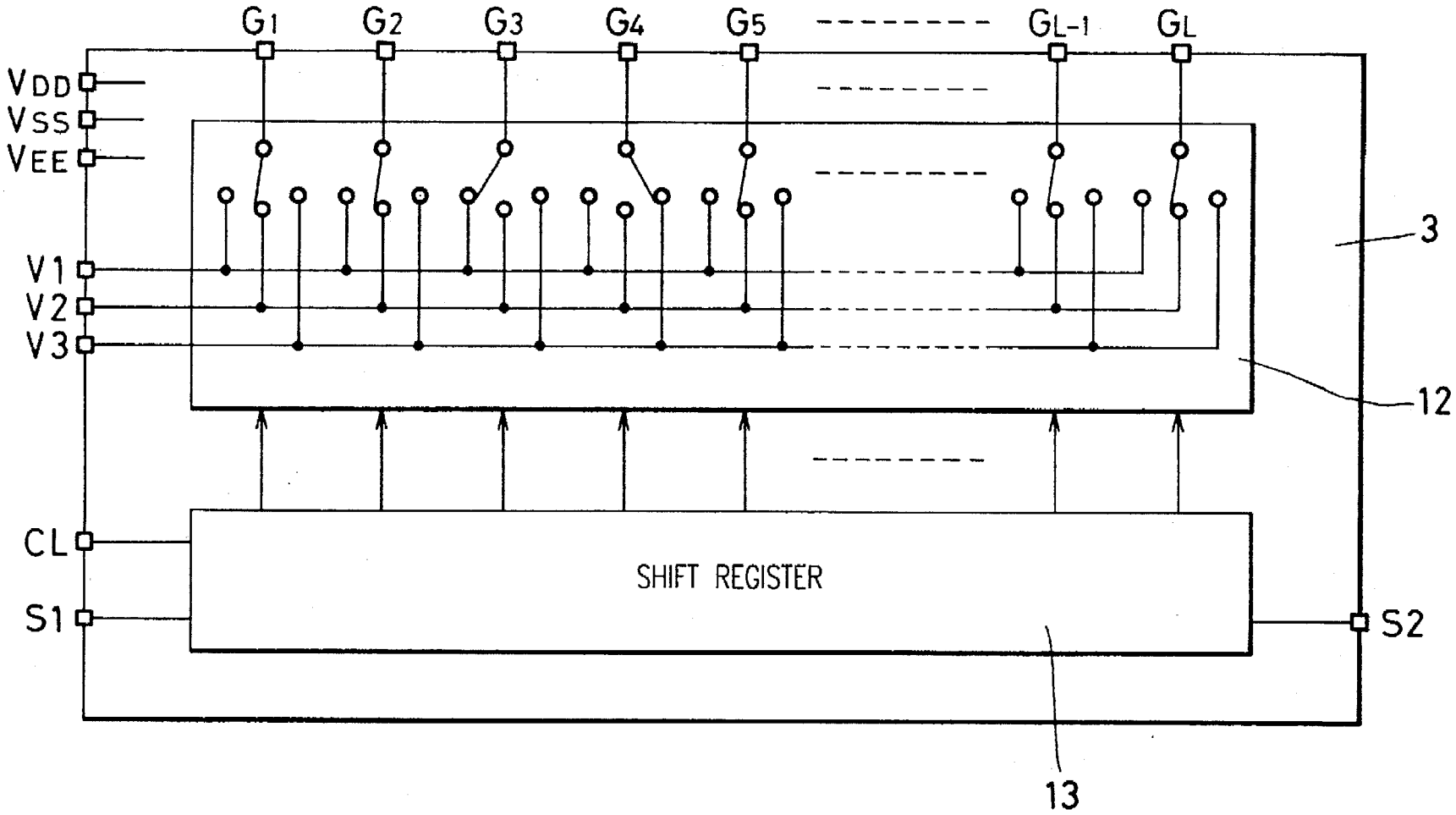
FIG. 3 is a block diagram of a scanning signal supply circuit of the liquid crystal display unit of the present invention.

FIG. 3 shows a block diagram of the scanning signal supply circuit 3. Referring to FIG. 3, there are comprised an output circuit 12, a shift register 13, a data input terminal S1 to the shift register 13, a data output terminal S2 from the shift register 13, a shift clock input terminal CL to the shift register 13, input terminals V1 through V3 of the scanning signal power voltage, power voltage input terminals $V_{DD}$, $V_{SS}$, and $V_{EE}$ for the scanning signal supply circuit 3, and output terminals $G_1$ through $G_L$ of the scanning signal $V_G$.

In the scanning signal supply circuit B, data input from the data input terminal S1 of the shift register 13 are successively transmitted according to a shift clock input from the shift clock input terminal CL. According to the transmitted data, the output circuit 12 selects the proper one among the voltages input to the input terminals V1 through V3 of the scanning signal power voltage for each of the scanning signal output terminals $G_1$ through $G_L$ and outputs the select scanning signal $V_G$ through the scanning signal output terminals $G_1$ through $G_L$.

Figure 4:
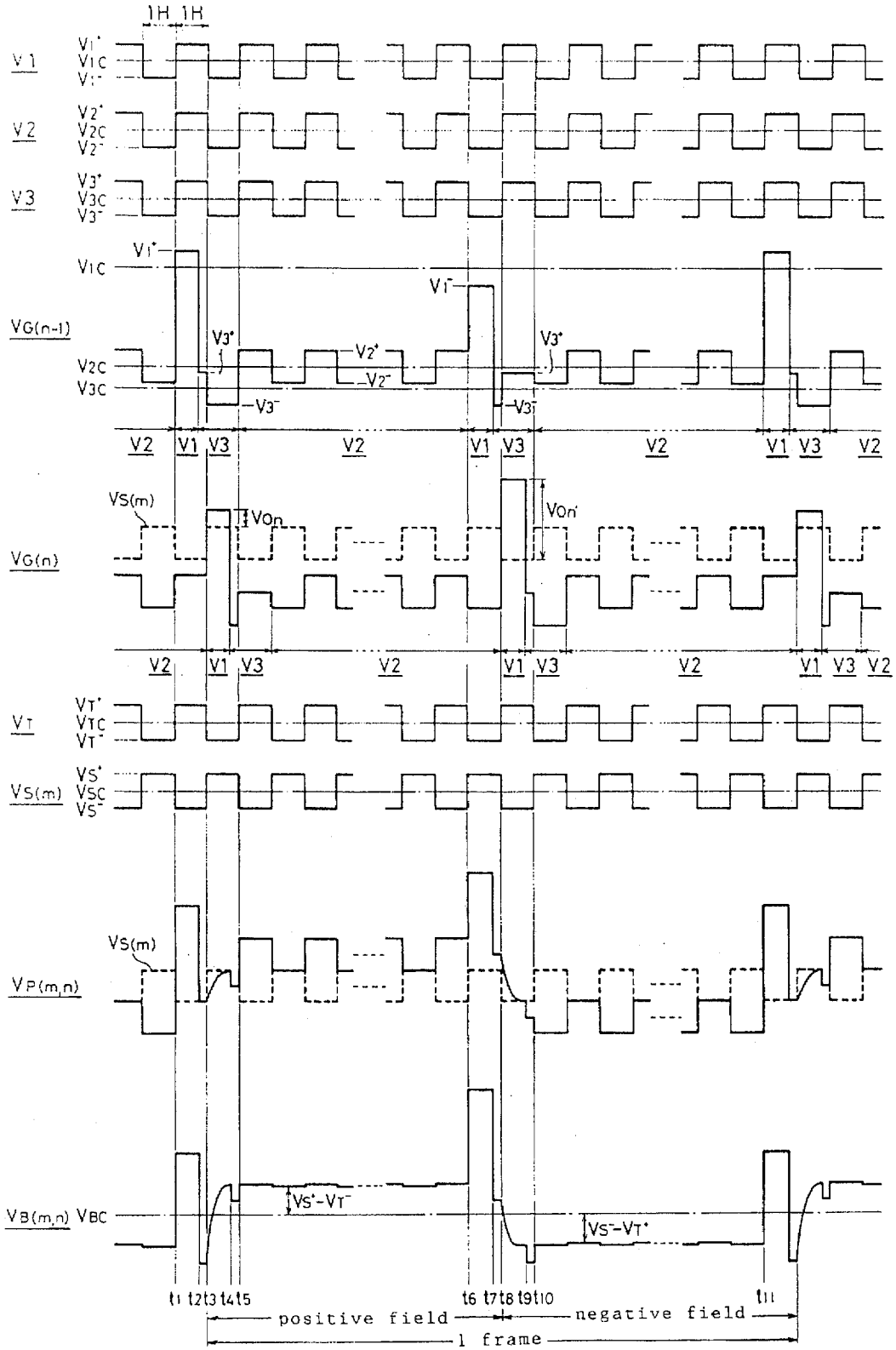
FIG. 4 is a chart of terminal waveforms and application voltage waveforms to the liquid crystal material in accordance with a first embodiment of the present invention shown in FIG. 2.

FIG. 4 shows waveforms of the scanning signal power voltages V1 through V3, a scanning signal $V_{G\ (n-1)}$ applied to an (n−1)th scanning signal line 10, a scanning signal $V_{G\ (n)}$ applied to an nth scanning signal line 10, a counter electrode signal $V_T$, an image signal $V_{S\ (m)}$, a voltage $V_{P\ (m,n)}$ at the pixel electrode 5, and an effective voltage (actual application voltage) $V_{B\ (m,n)}$ to the liquid crystal material.

Scanning signal power voltages V1, V2, and V3 are power voltages input respectively to the scanning signal power voltage input terminals V1, V2, and V3 of the scanning signal supply circuit 3 as shown in FIG. 3.

Voltages $V_1^+$, $V_2^+$, and $V_3^+$ are high-level voltages, voltages $V_1^-$, $V_2^-$, $V_3^-$ are low-level voltages, and voltages $V_{1C}$, $V_{2C}$, and $V_{3C}$ are central value (average value) voltages of the waveforms respectively. It is noted that the central value voltages $V_{1C}$, $V_{2C}$, and $V_{3C}$ are determined so that a relation of $V_{1C}>V_{2C}>V_{3C}$ holds.

The scanning signal power voltages V1, V2, and V3 vary in phase with the counter electrode signal $V_T$ applied to the counter electrode 11. In more detail, to obtain a scanning signal which concurrently serves as a modulation signal, there are needed a voltage V1 for turning on the switching transistor 4, a voltage V2 for turning off the switching transistor 4, and a voltage V3 for producing a modulation signal. It is preferred to vary each of the above-mentioned scanning signal power voltages V1, V2, and V3 between a high-level voltage and a low-level voltage so that the polarity of the counter electrode signal $V_T$ can be inverted in synchronization with the polarity of the image signal $V_{S\ (m)}$ to enable the image signal $V_{S\ (m)}$ to be reduced in amplitude. In the above regard, six sorts of power voltages $V_1^+$, $V_1^-$, $V_2^+$, $V_2^-$, $V_3^+$, and $V_3^-$ are necessary. However, when the six sorts of power voltages are input to the scanning signal supply circuit 3, six lines are necessary for the scanning signal power voltages and six selector switches are necessary for the output sections. However, by inputting the varying scanning signal power voltages to the scanning signal supply circuit 3, only three sorts of scanning signal power voltages V1, V2, and V3 are necessary. With the above-mentioned arrangement, the scanning signal power voltage lines and the power selector switches in the scanning signal supply circuit 3 can be simplified to enable the circuit scale of the scanning signal supply circuit 3 to be reduced.

The scanning signal $V_{G\ (n-1)}$ is output from the output terminals $G_1$ through $G_L$ of the scanning signal supply circuit 3 as shown in FIG. 3 to be applied to the (n−1)th scanning signal line 10 as shown in FIG. 2 as formed by selecting one of the scanning signal power voltages V1, V2, and V3 every prescribed period. In more detail, during the period of time $t_1$ to time $t_2$, the scanning signal power voltages V1 is selected. During the period of time $t_2$ to time $t_5$, the scanning signal power voltages V3 is selected. During the period of time $t_5$ to time $t_6$, the scanning signal power voltage V2 is selected. Therefore, the scanning signal $V_{G\ (n-1)}$ is composed of six levels of $V_1^+$, $V_1^-$, $V_2^+$, $V_2^-$, $V_3^+$, and $V_3^-$ having a waveform repeating in a constant cycle. In regard of the scanning signal $V_{G\ (n-1)}$, voltages $V_{1C}$, $V_{2C}$, and $V_{3C}$ are central values of the above-mentioned scanning signal power voltages V1, V2, and V3.

The scanning signal $V_{G\ (n)}$ is a scanning signal to be applied to the nth scanning signal line 10 as delayed by 1H from the scanning signal $V_{G\ (n-1)}$ in selecting the scanning signal power voltages V1, V2, and V3. The scanning signal $V_{G\ (n)}$ is also composed of six levels of $V_1^+$, $V_1^-$, $V_2^+$, $V_2^-$, $V_3^+$, and $V_3^-$ in the same way as the scanning signal $V_{G\ (n-1)}$.

The image signal $V_{S\ (m)}$ is a signal to be applied to mth image signal line 9 as periodically inverted in polarity everycycle of 1H, where $V_S^+$ is a positive voltage, $V_S^-$ is a negative voltage, and $V_{SC}$ is the central value (average value) voltage of the image signal $V_{S\ (m)}$.

The counter electrode signal $V_T$ is a signal applied to the counter electrode 11 as periodically inverted in polarity every cycle of 1H in synchronization with inversion in polarity of the image signal $V_{S\ (m)}$, where $V_T^+$ is a positive voltage, $V_T^-$ is a negative voltage, and $V_{TC}$ is the central value (average value) voltage of the counter electrode signal $V_T$. As described above, by inverting the counter electrode signal $V_T$ in reverse phase to the polarity of the image signal $V_{S\ (m)}$, the amplitude of the image signal $V_{S\ (m)}$ can be reduced to enable the image signal supply circuit 2 to be compacted, achieving a low power consumption.

The voltage $V_{P\ (m,n)}$ at the pixel electrode 5 has a waveform obtained by superimposing the (n−1)th scanning signal $V_{G\ (n-1)}$ on the image signal $V_{S\ (m)}$ via the additional capacitance 8 ($C_S$). In other words, by modulating the voltage at the pixel electrode 5 with the signal of the scanning signal line via the additional capacitance 8, the direct current component of the voltage applied to the liquid crystal material is eliminated to enable a liquid crystal display unit having an excellent gradation reproducibility without incurring burning of the screen.

The following describes the operation of the active matrix type liquid crystal display unit having the above-mentioned construction.

In regard of the scanning signal $V_{G\ (n-1)}$ applied to the (n−1)th scanning signal line 10, the scanning signal power voltage V1 is output from the scanning signal supply circuit 3 during the period of time $t_1$ to time $t_2$ and the period of time $t_6$ to time $t_7$, the scanning signal power voltage V3 is output from the scanning signal supply circuit 3 during the period of time $t_2$ to time $t_5$ and the period of time $t_7$ to time $t_{10}$, and the scanning signal power voltage V2 is output from the scanning signal supply circuit 3 during the period of time $t_5$ to time $t_6$ and the period of time $t_{10}$ to time $t_{11}$.

In regard of the scanning signal $V_{G\ (n)}$ applied to the nth scanning signal line 10, the scanning signal power voltages V1, V2, and V3 are each output as delayed by one horizontal scanning period of 1H from the scanning signal $V_{G\ (n-1)}$.

At the timing of outputting the scanning signal power voltage V1 of the nth scanning signal $V_{G\ (n)}$, i.e., during the period of time $t_3$ to time $t_4$ and the period of time $t_8$ to time $t_9$, the switching transistor 4 turns on to supply the instantaneous image signal $V_{S\ (m)}$ to the pixel electrode 5. At another timing, although the switching transistor 4 is off, the voltage $V_{P\ (m,n)}$ at the pixel electrode 5 varies due to a capacitance between the pixel electrode and adjacent lines. Since the additional capacitance 8 ($C_S$) is sufficiently greater than the other capacitance, the waveform of the voltage $V_{P\ (m,n)}$ applied to the pixel electrode 5 varies in a manner such that the signal waveform of the (n−1)th scanning signal $V_{G\ (n-1)}$ is superimposed on the image signal voltage $V_{S\ (m)}$ via the additional capacitance 8.

Consequently, the voltage $V_{B\ (m,n)}$ actually applied to the liquid crystal material has the value that is obtained by subtracting the voltage $V_T$ applied to the counter electrode 11 from the voltage $V_{P\ (m,n)}$ applied to the pixel electrode 5 to enable the provision of a stable waveform which is periodically inverted in a constant cycle as indicated by the waveform $V_{B\ (m,n)}$ shown in FIG. 4.

When the scanning signal $V_{G\ (n)}$ varies from $V_1^+$ to $V_3^-$ at time $t_4$, the effective voltage $V_{B\ (m,n)}$ applied to the liquid crystal material reduces due to the parasitic capacitance $C_{GD}$ between the gate and the drain of the switching transistor 4. However, at the subsequent time $t_5$, the voltage of the scanning signal $V_{G\ (n-1)}$ in the previous stage varies from $V_3^-$ to $V_2^+$ to offset the voltage reduction via the additional capacitance 8 ($C_S$). By arranging the above-mentioned signal levels so that the relation of $(V_{1C}-V_{2C})\cdot C_{GD}\doteq(V_{2C}-V_{3C})\cdot C_S$ is satisfied, a voltage of $V_3^+-V_T^-$ is consequently applied to the liquid crystal material during the period of time $t_5$ to time $t_6$. At the time $t_9$ and $t_{10}$, the same operation as described above is performed to consequently apply a voltage of $V_S^--V_T^+$ to the liquid crystal material during the period of time $t_{10}$ to time $t_{11}$. By making the central voltage $V_{SC}$ of the image signal $V_{S\ (m)}$ approximately coincide with the central voltage $V_{TC}$ of the counter electrode signal $V_T$, the average level $V_{BC}$ of the voltage applied to the liquid crystal material can be made to be 0 V in disregard of the capacitance $C_{LC}$ of the liquid crystal material.

Figure 5:
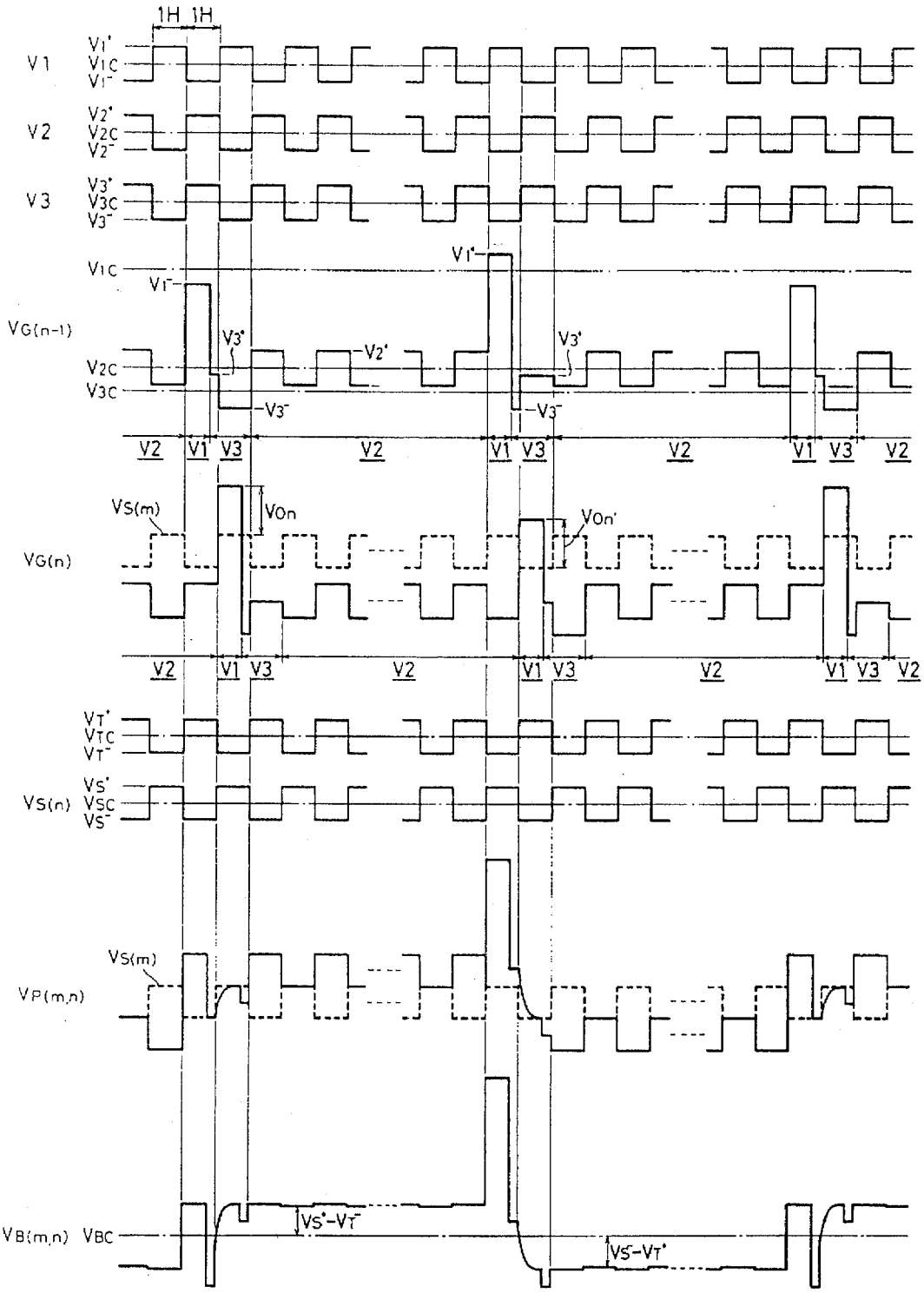
FIG. 5 is a chart of terminal waveforms and application voltage waveforms to the liquid crystal material in accordance with a second embodiment of the present invention shown in FIG. 2.
Figure 6:
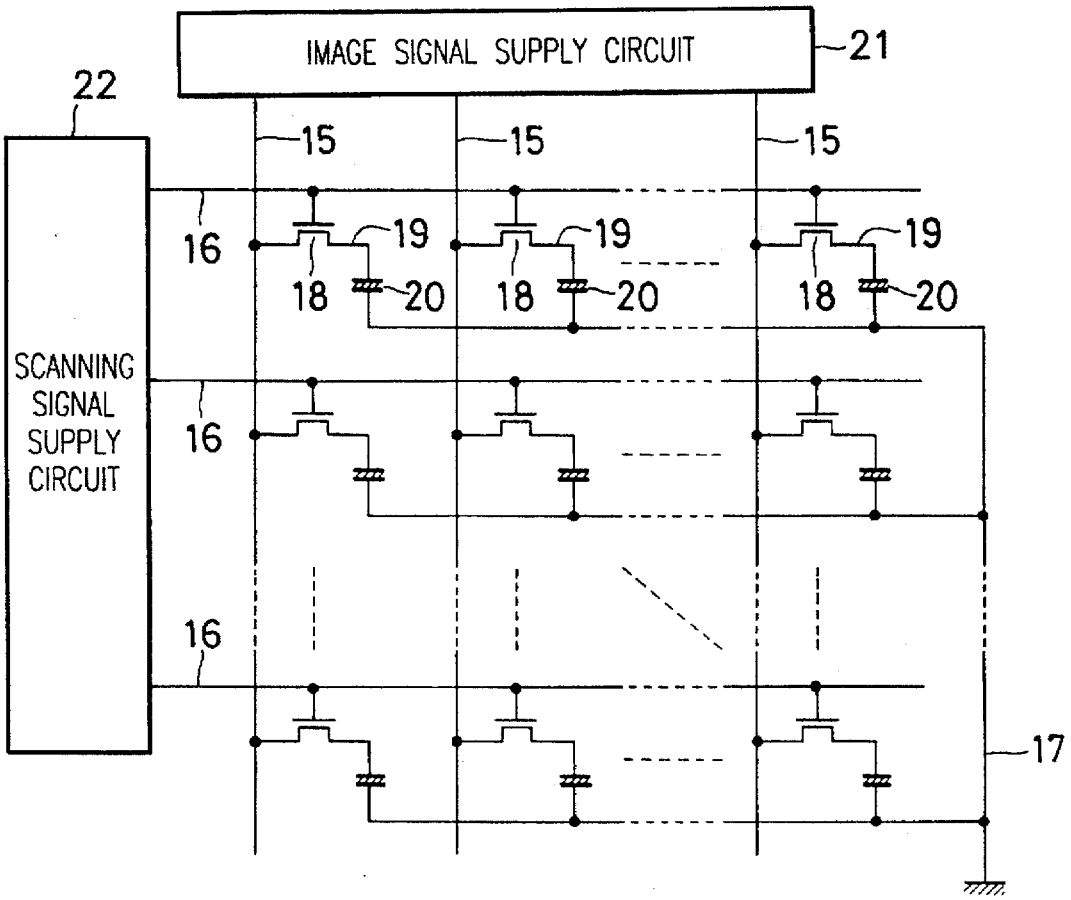
FIG. 6 PRIOR ART
FIG. 6 is a diagram of a conventional liquid crystal display unit.
Figure 7:
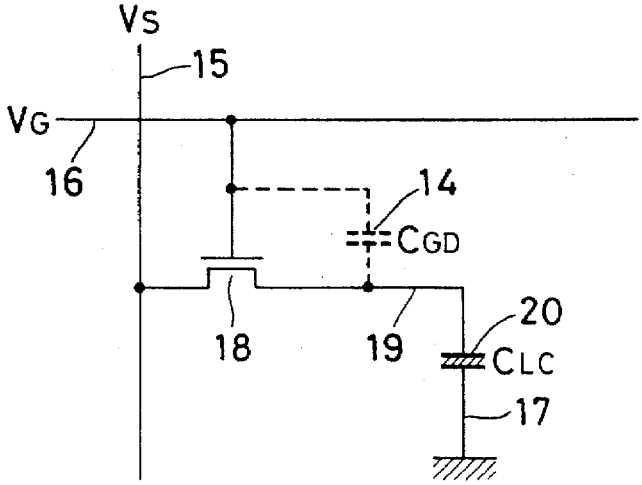
FIG. 7 PRIOR ART
FIG. 7 is an equivalent circuit diagram of one pixel of the conventional liquid crystal display unit.
Figure 8:
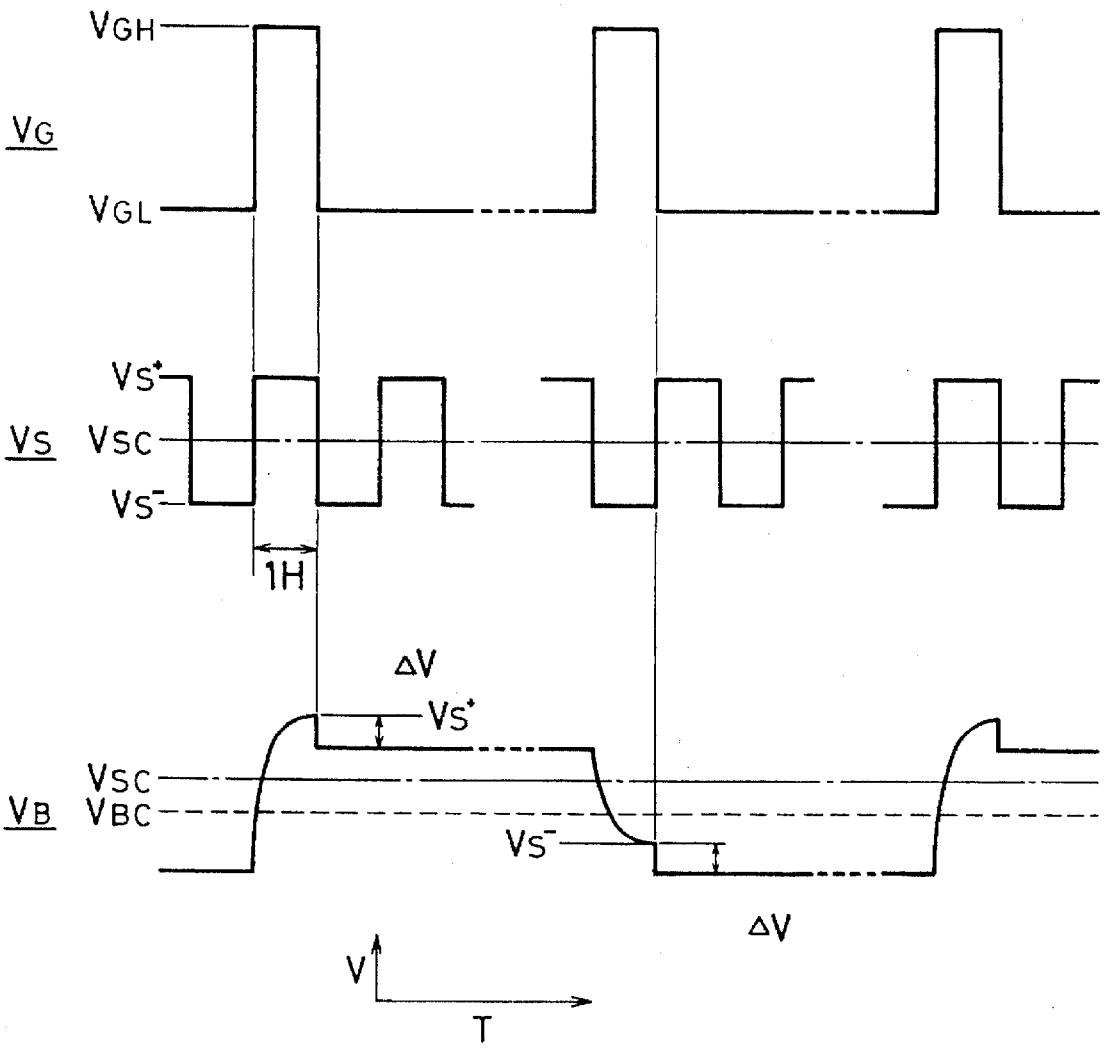
FIG. 8 PRIOR ART
FIG. 8 is a chart of terminal waveforms and application voltage waveforms to the liquid crystal display unit shown in FIG. 7.

FIG. 5 shows the transition in time of voltages applied to the terminals shown in FIG. 2 in accordance with the second embodiment of the present invention. The present construction differs from the construction shown in FIG. 4 in that the waveform of the voltage V1 for turning on the switching transistor is in reverse phase to the waveform of the counter electrode signal $V_T$ applied to the counter electrode 11.

With the above-mentioned arrangement, there is reduced the difference between the effective gate voltage for turning on the switching transistor in the positive field and the effective gate voltage for turning on the switching transistor in the negative field either of which voltages is applied to the liquid crystal material in comparison to the waveform of the first embodiment shown in FIG. 4 to thereby make the $V_{ON}$ and $V_{ON}$ approximately equal to each other. Therefore, an approximate equal capability of supplying power to the pixel electrode 5 is assured in either one of the fields. As a result, the voltage $V_{B\ (m,n)}$ applied to the liquid crystal material is able to have equal values in the positive and negative fields to enable a more reliable method for driving a liquid crystal display unit.

Although the scanning signal power voltages V1 through V3 are provided independently from the power voltages ($V_{DD}$, $V_{SS}$, and $V_{EE}$) of the scanning signal supply circuit 3 in the above-mentioned embodiment, it is also permissible to integrate a part or all of both the power voltages.

Although the voltage waveform of the scanning signal power voltage V1 is varied in phase or in reverse phase in synchronization with the waveform of the counter electrode signal $V_T$ in the above-mentioned first inventive method, the scanning signal power voltage V1 may take any voltage waveform so long as it can provide a voltage for turning on the switching transistor. For instance, the voltage may be a constant voltage set at the central voltage $V_{1C}$ of the scanning signal power voltage V1 as shown in FIG. 4 to produce a sufficient effect, which is the second inventive method.

As described above, according to the method for driving a liquid crystal display unit of the present invention, a plurality of scanning signal power voltages of which levels vary in synchronization with inversion in polarity of the image signal are input to the scanning signal supply circuit, and any of the plural scanning signal power voltages is selected to serve as a scanning signal. Otherwise, some scanning signal power voltages of which levels vary in synchronization with inversion in polarity of the image signal and some scanning signal power voltages of which levels are invariable are input to the scanning signal supply circuit, and any of the plural scanning signal power voltages is selected to serve as a scanning signal. With the above-mentioned arrangement, the modulation signal can be supplied from the scanning signal line as superimposed on the scanning signal to obviate the need of the modulation signal supply circuit and the modulation signal lines while enabling reduction of the circuit scale of the scanning signal supply circuit. As a result, the direct current component of the voltage applied to the liquid crystal material can be eliminated to enable the image signal supply circuit and the scanning signal supply circuit to be compacted, thereby providing a method for driving a liquid crystal display unit assuring low power consumption and excellent gradation reproductbility without incurring burning of the screen.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A method for driving an active matrix liquid crystal display unit comprising:

interposing a liquid crystal material between a plurality of pixel electrodes and an electrode, the liquid crystal material exhibiting dielectric anisotropy;

connecting a switching transistor to each of the plurality of pixel electrodes;

supplying a scanning signal for turning on and off the switching transistor from a scanning signal supply circuit to the switching transistor via a scanning signal line;

supplying an image signal from an image signal supply circuit to each of the pixel electrodes via an image signal line and the switching transistor, the image signal comprising two kinds of voltage level signals;

supplying a counter electrode signal to the electrode, the counter electrode signal comprising two kinds of voltage level signals;

inputting to the scanning signal supply circuit a plurality of scanning signal power voltages having levels that vary in synchronization with an inversion in polarity of the image signal; and combining the plurality of scanning signal power voltages to serve as the scanning signal for turning on and off the switching transistor connected to each of the plurality of pixel electrodes, whereby variance of the application voltage attributable to the dielectric anisotropy of the liquid crystal material is eliminated and whereby the image signal and the counter electrode signal form an alternating voltage and are impressed on the liquid crystal material.

2. A method for driving a liquid crystal display unit as claimed in claim 1, comprising:

forming an additional capacitance by capacitively connecting each of the pixel electrodes with the scanning signal line adjacent to each of the pixel electrodes, and supplying the scanning signal of the adjacent scanning signal line to the pixel electrode via the additional capacitance to eliminate a direct current component of a voltage applied to the liquid crystal material.

3. A method for driving a liquid crystal display unit as claimed in claim 1, wherein, among the scanning signal power voltages, a scanning signal power voltage for turning on the switching transistor is varied in synchronization with the image signal so that the power voltage is in phase with the image signal.

4. A method for driving an active matrix liquid crystal display unit comprising:

interposing a liquid crystal material between a plurality of pixel electrodes and an electrode, the liquid crystal material exhibiting dielectric anisotropy;

connecting a switching transistor to each of the plurality of pixel electrodes;

supplying a scanning signal for turning on and off the switching transistor from a scanning signal supply circuit to the switching transistor via a scanning signal line;

supplying an image signal from an image signal supply circuit to each of the pixel electrodes via an image signal line and the switching transistor, the image signal comprising two kinds of voltage level signals;

supplying a counter electrode signal to each of the counter electrode, the counter electrode siqnal comprising two kinds of voltage level signals;

inputting to the scanning signal supply circuit scanning signal power voltages having levels that vary in synchronization with an inversion in polarity of the image signal and scanning signal power voltages having levels that are invariable; and combining the plurality of scanning signal power voltages to serve as the scanning signal for turninq on and off the switching transistor connected to each of the plurality of pixel electrodes, whereby variance of the application voltage attributable to the dielectric anisotropy of the liquid crystal material is eliminated and whereby the image signal and the counter electrode siqnal form an alternating voltage and are impressed on the liquid crystal material.

5. A method for driving a liquid crystal display unit as claimed in claim 4, comprising:

forming an additional capacitance by capacitively connecting each of the pixel electrodes with the scanning signal line adjacent to each of the pixel electrodes, and supplying the scanning signal of the adjacent scanning signal line to the pixel electrode via the additional capacitance to eliminate a direct current component of a voltage applied to the liquid crystal material.

6. A method for driving a liquid crystal display unit as claimed in claim 4, wherein one of the plurality of scanning signal power voltages is a scanning signal power voltage of which level is invariable to turn on the switching transistor.

* * * * *